US005829996A

United States Patent [19]

Yamane et al.

[11] Patent Number: 5,829,996

[45] Date of Patent: Nov. 3, 1998

[54] PC CARD AND PC CARD CONNECTOR

[75] Inventors: Masahiro Yamane; Kazuhisa Tunematsu, both of Tokyo, Japan

[73] Assignee: Hirose Electric Co., Ltd., Tokyo, Japan

[21] Appl. No.: 634,227

[22] Filed: Apr. 18, 1996

[30] Foreign Application Priority Data

May 12, 1995 [JP] Japan ..... 7-137446

[51] Int. Cl.[6] ..... H01R 13/629

[52] U.S. Cl. ..... 439/310; 439/347; 439/159; 385/89

[58] Field of Search ..... 439/64, 259, 266, 439/267, 310, 347, 377, 159, 160; 385/88, 89

[56] References Cited

U.S. PATENT DOCUMENTS 4,843,477 6/1989 Mizutani et al. ..... 439/310
5,205,753 4/1993 Butterfield et al. ..... 439/310
5,517,387 5/1996 Smith ..... 439/259
5,525,795 6/1996 MacGregor et al. ..... 361/801

*Primary Examiner*—Neil Abrams
*Attorney, Agent, or Firm*—Kanesaka & Takeuchi

[57] ABSTRACT

A PC card (1) includes a plate-like body having a front face (2) and at least one side face (4) extending in a card insertion direction; a plurality of signal contact elements (3) provided at the front face (2) for coupling to (10) a connector; and at least one signal connection member (6) provided on the side face (4) for receiving and sending signals from and to a movable external signal connection member (15). The external signal connection member is mounted on a guide track (11), biased by a spring (22) and may include a pin (21) for engaging a retaining hole (7) in the card (1). The connection external member is movable out of the path of the card (1) by use of moving lever (31) having a cam section (37), a swinging lever (71), FIG. 9, or a cam member (85) that is actuatable by a card removing lever (81), FIG. 11.

6 Claims, 12 Drawing Sheets

PC CARD AND PC CARD CONNECTOR

BACKGROUND OF THE INVENTION

1. Field of the Invention

This invention relates to PC cards and connectors therefor.

2. Description of the Prior Art

A PC card has a plate shape, which is inserted into a connector inside a slot provided on a case of an electronic device, such as computer. The PC card includes a plurality of signal contact elements at the front end face for coupling to corresponding contact elements of the connector. The plurality of signal contact elements require occupying almost all the front end face of the PC card for their arrangement.

The PC card may need a shielded connection terminal according to the purpose for which the card is used. However, no conventional PC card can provide such a connection terminal at the front end face since the contact elements are disposed over the full width of the front end face. In order to provide the connection terminal, it would be considered that a thick, enlarged portion is formed on the front end face of the PC card to arrange the shielded connection terminal.

As a result, the electrical connector and the slot, respectively receiving and inserting the PC card therein, must have shapes corresponding to the enlarged portion.

The shielded connection terminal, however, has a relatively large diameter, almost as large as the full width of the PC card, so that, if the enlarged portion is formed, the PC card will become almost double as thick as the conventional one. This results in a large-sized connector and a large-opened slot, letting dust in. Even if the enlarged portion is formed locally at the front end face of the PC card, it will be ineffective in solving the above problems of the connector and the slot. For the PC card, it is also inconvenient when plural types of PC cards are used at the same electrical device since a swelling-like enlarged portion is added to the conventional plate-like PC card having an uniform thickness.

SUMMARY OF THE INVENTION

Accordingly, it is an object of the present invention to provide a PC card having signal connection members, which has a thickness as small as that of the uniformly flat, conventional PC card and a number of signal contact elements at the front end face as large as that of the conventional PC card.

It is another object of the present invention is to provide a connector capable of receiving the above PC card easily and coupling to the external signal connection terminals.

In the present invention, the signal connection members can be either shielded connection terminals or connection terminals for optical fiber cables.

According to one aspect of the present invention, there is provided a plate-like PC card including a plurality of signal contact elements at a front end face for coupling to a connector, at least one signal connection member on the side face extending parallel to the card insertion direction for receiving and sending signals from and to external signal connection members.

The PC card can also includes a retaining hole on the side face for fixing the PC card in a predetermined position relative to the connector, thereby establishing a connection with the external signal connection member securely and smoothly.

According to another aspect of the present invention, there is provided a connector for the PC card, which includes a guiding section over both sides for leading the plate-like PC card along the side faces and a receiving member movable back and forth so that the front end face of the PC card can be received at the time of connection with the contact elements of the connector, a signal connection support, which is movably disposed on one side of the guiding section corresponding to the side face of the PC card and biased by a spring member toward the side face, and a moving unit for manually moving the signal connection support from the side face against the spring member.

According to an embodiment of the present invention, the moving unit of the connector includes a moving lever extending in the guidance direction of the guiding section and a cam section provided both in the middle part of the moving lever and the signal connection support, such that the cam section permits the signal connection support to move toward the side face of the PC card by pushing the outside end of the moving lever forwardly.

According to another embodiment of the present invention, the moving unit further includes a moving lever extending in the guidance direction of the guiding section and swinging on a supporting point, such that the signal connection support is permitted to move from or toward the side face of the PC card by utilizing the principles of the lever, that is, by swinging the moving lever at the outside end.

According to still another embodiment of the present invention, the moving unit is linked with a card removing unit. In this case, the moving unit includes a card removing lever moved along the side of the guiding section opposite to the signal connection members and a shifter lever swingingly supported by a support point on a coupling part operative to couple two guiding parts of the guiding section together, the shifter lever of which one end is movably connected with the front end of the card removing lever or its related part and the other end forms a pushing face operative to move the receiving member in the card removal direction, so that the receiving member or its related part cooperates with the signal connection support to form a cam unit operative to move the signal connection support away from the side face of the PC card. At this time, the cam unit preferably operates prior to card removal.

In the connector of the present invention, the signal connection support can also includes a projecting shaft to be fitted in the retaining hole of the PC card, thereby establishing a connection between the PC card and the connector through the both sides of signal connection members in an accurate position.

The above-mentioned PC card and the PC card connector of the present invention can be operated in the following manner.

(1) The moving unit of the connector is first started by manual operation of the moving lever or the card removing lever and thereby the signal connection support moves outwardly against the spring member.

(2) In this condition, the PC card is inserted in the connector. Once the PC card comes to a predetermined position in the receiving member and is connected to the connector through the both sides of contact elements, the moving unit is released from standing against the spring member and thereby the signal connection support is biased by the spring member toward the side face of the PC card. As a result, the external signal connection members supported by the signal connection support are connected to the signal connection members of the PC card.

(3) At removal of the PC card, the moving unit is moved outwardly in the same manner as (1) and thereby the PC card is removed by the card removing lever or the like.

(4) In addition, the present invention can be applied to both of combinations, i.e., an electrical cable and a substrate, and, an optical fiber cable and a substrate. In the former combination, the signal connection members supported by the signal connection support are coupled to the PC card in contact with the connection terminals thereof. On the other hand, the latter combination may avoid direct contact with each other, leaving a space therebetween.

The above and other objects, features, and advantages of the invention will be more apparent from the following description when taken in conjunction with the accompanying drawings.

DESCRIPTION OF THE PREFERRED EMBODIMENT

Figure 1:
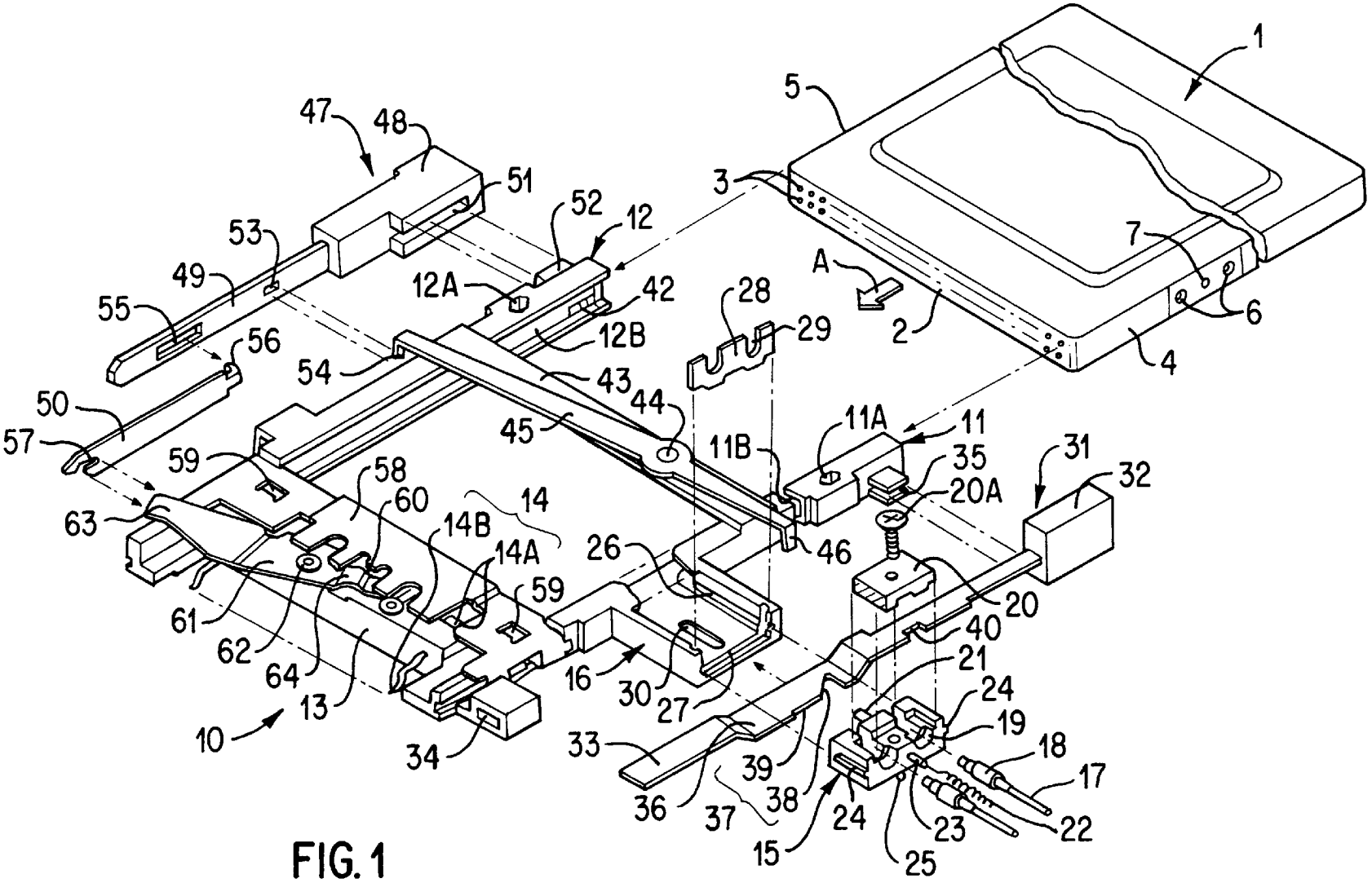
FIG. 1 is an exploded perspective view of a PC card and a card connector according to an embodiment of the present invention.
Figure 2:
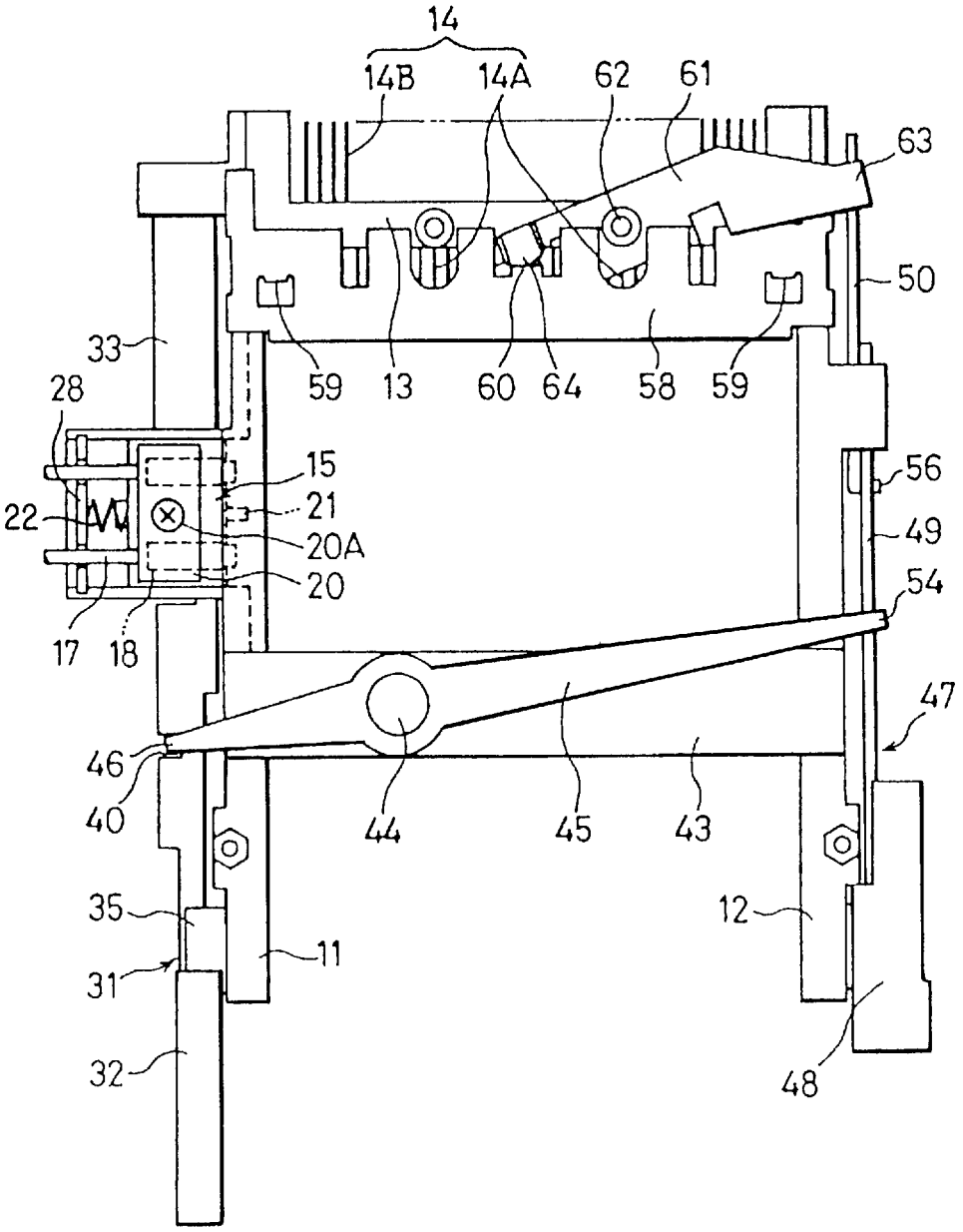
FIG. 2 is a plan view of the connector of FIG. 1.
Figure 3:
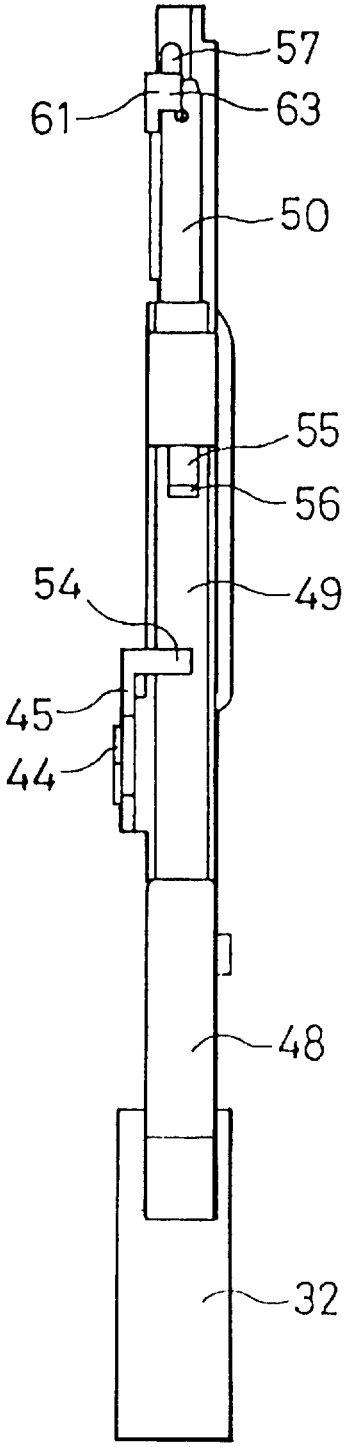
FIG. 3 is a right side view of FIG. 2.
Figure 4:
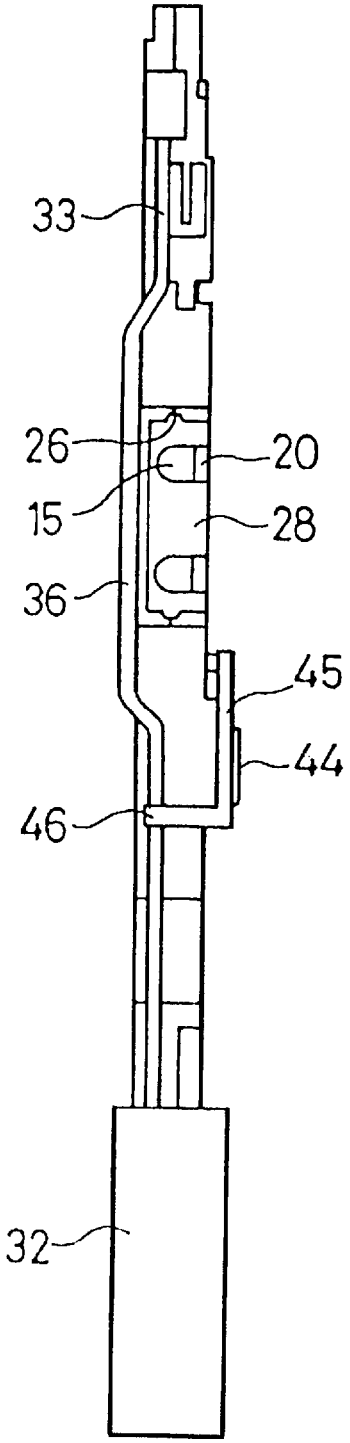
FIG. 4 is a left side view of FIG. 2.
Figure 5:
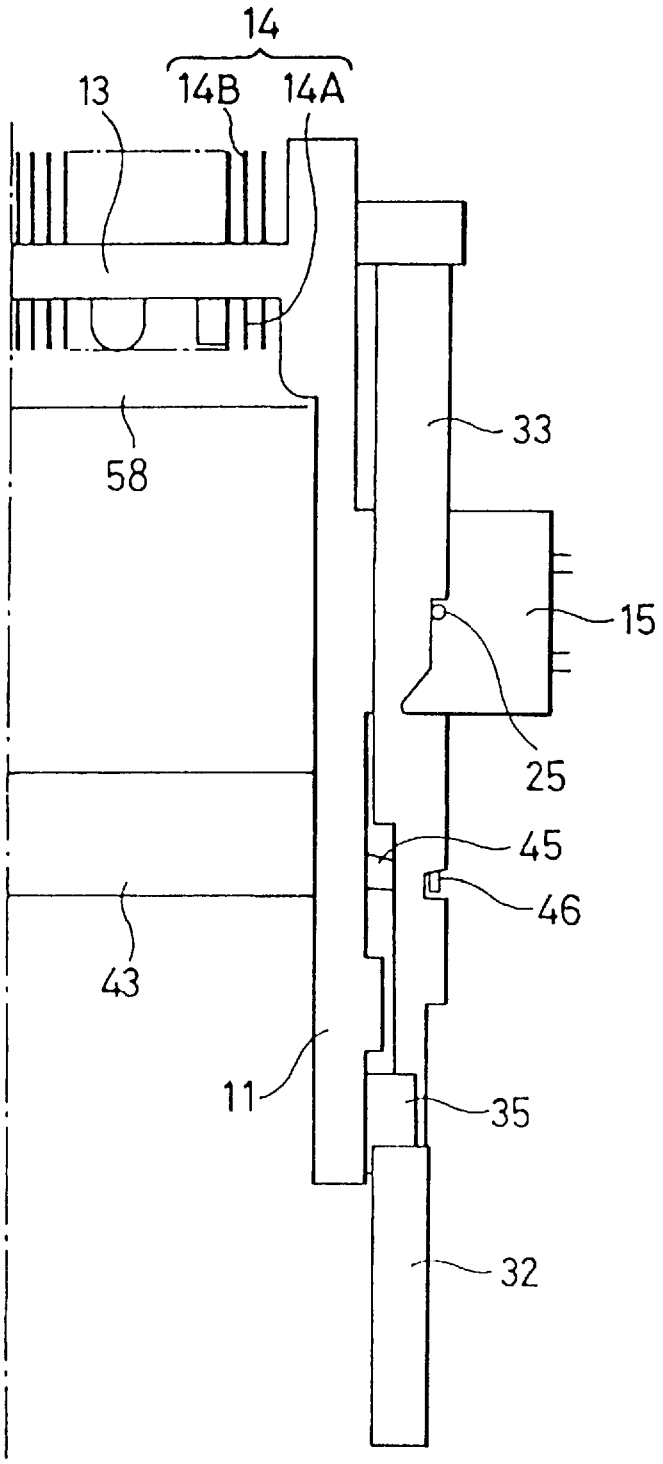
FIG. 5 is a bottom plan view of the left half of the connector shown in FIG. 2.
Figure 6:
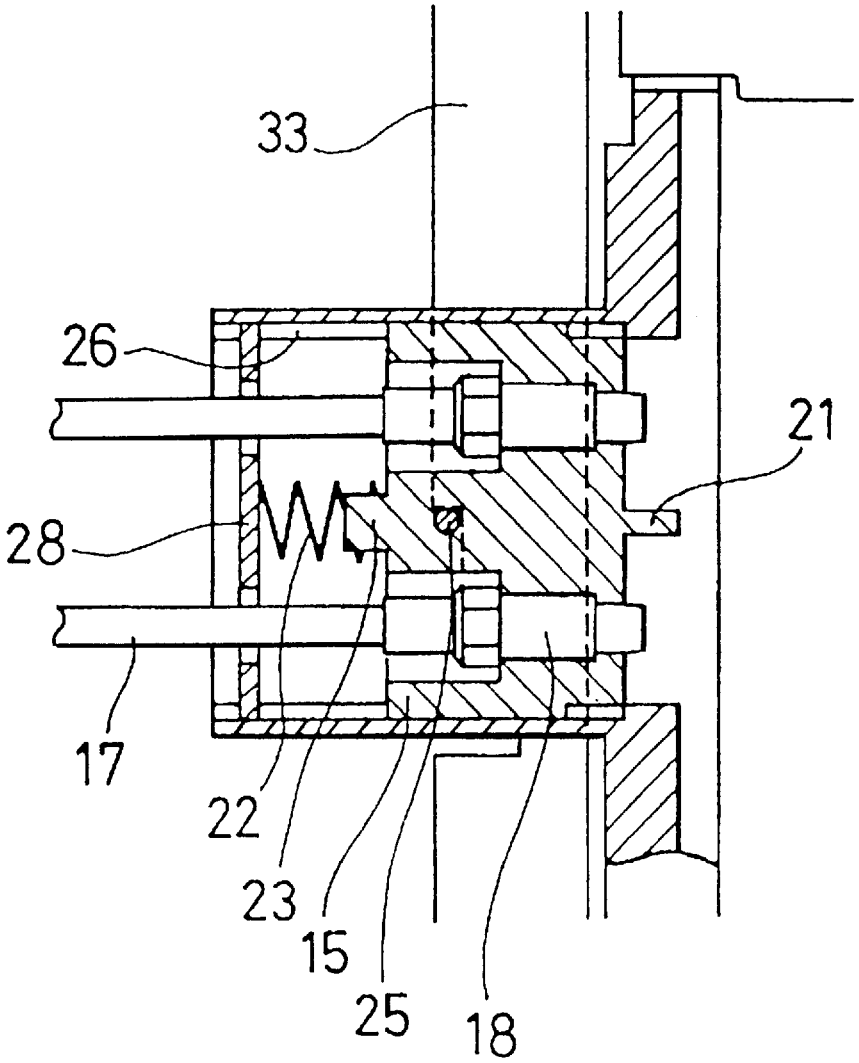
FIG. 6 is a sectional view of a cable support and its vicinities shown in FIG. 2.

In FIGS. 1–6, a PC card 1 has a plate shape with a substantially uniform thickness and includes a plurality of signal contact elements 3 disposed over the full width of the front end face 2 opposite to a connector in an insertion direction A. In the embodiment, while the contact elements 3 are female-type contact elements disposed in two lines, the present invention is not limited thereto and the contact elements may be male-type. Also, the contact elements 3 can be disposed in a line, three lines or more. In addition, guiding parts 11 and 12 and the connector 10 are disposed in a line, though, they can be disposed in two lines, three lines or more as well.

The PC card has side faces 4 and 5 parallel to the direction A. On one side face 4, two shielded connection terminals 6 for coaxial shielded cables are respectively provided in front and in rear as signal connection members. The shielded connection terminals 6 may be connected with solder to a substrate in the PC card 1. Such shielded connection terminals can be either male type or female type. These shielded connection terminals 6 are positioned on almost the same face as the side face 4 and connected with respective circuits in the PC card 1.

A retaining hole 7 is formed between the two shielded connection terminals 6 on the side face 4 for positioning the PC card 1 and preventing it from dropping off.

On the other hand, the connector 10 for receiving the PC card 1 includes two guiding parts 11 and 12 extending parallel to the card insertion direction and guiding the side faces 4 and 5 of the PC card 1. Both of the guiding parts 11 and 12 are united with a coupling part 13 deep in the direction A. A plurality of male contact elements 14 are then implanted back and forth through the coupling part 13. The contact elements 14 are constituted of connection part elements 14A which are disposed in two lines toward the PC card so as to correspond to the contact elements 3, respectively, and wiring part elements 14B which are each bent and disposed outwardly in a line so as to uniformly contact on a face of a circuit substrate, not shown.

The guiding part 11 includes a guiding groove 11B inside with a channel-like cross section extending in the length direction and a projecting face on which a screw hole 11A is formed to house the screw head so that the guiding part 11 can be fixed to the device. In the middle of the guiding part 11, a housing 16 extends toward the outside for housing a cable support 15, a signal connection support, having a inwardly open, U-type cross section.

On the cable support 15, two U-type grooves 19 are formed to house coaxial terminals 18, as signal connection members, to which shielded cables 17 are connected in this embodiment. The coaxial terminals 18 are fixed by tightening a cover with screw 20A from the upside. These coaxial terminals can contact directly with respective contact parts on the substrate. In this case, the coaxial terminals, of course, are slidable along the contact parts on the substrate. On the opposite side of the cable support 15, a projecting shaft 21 is provided which can enter the retaining hole 7 to position the PC card 1. On the shielded cable side, a spring retaining tube 23 is provided for supporting a coil spring 22 served as an elastic member. The elastic member may be other type of spring or other elastic material, such as rubber or plastic. The cable support 15 further includes guided rails 24 on the front and back faces which are guided along the side faces of the housing 16. In addition, a cam shaft 25 projects downwardly from the bottom face of the cable support 15 so as to interlock with a cam described later.

On the inside faces of the housing 16 provided in the guiding part 11, guiding grooves 26 extend to a predetermined positions, respectively, along which the cable support 15 is guided with its guided rails 24. Around the inside wall face, a U-type groove 27 is formed along an outline to which the outside face of the cable support 15 is corresponded when the cable support 15 has been inserted in the housing 16 along the guiding grooves 26 and come to the predetermined position. A keep plate 28 is then pressed into the U-type groove 27 under pressure. The keep plate 28 has U-type cutting parts 29 opened upwardly so that the cables 17 connected to the respective coaxial terminals 18 can be inserted into or removed from the cable support 15 after the keep plate 28 has been fitted in the U-type groove 27.

The spring 22 decided in position by the spring retaining tube 23 is pressed between the cable support 15 and the keep plate 28, biasing the cable support 15 toward the inside. The cam shaft 25 on the bottom face of the cable support 15 projects downwardly from an elongated hole 30 on the bottom of the housing 16 and is movable along the elongated hole 30.

A moving lever 31 is provided outside of the guiding part 11 for moving the cable support 15 from and to the PC card 1. The moving lever 31 is provided with a push-button part 32 at back end and a lever part 33 extending forwardly from the push-button part 32. The lever part 33 has flat faces at back and front ends to be put respectively in guiding grooves 34 and 35 provided on the outside face of the guiding part 11, thereby moving back and forth. In the middle of the lever part 33, a bend 36 with a cam section 37 is formed downwardly so as to go around the housing 16. The cam section consists of a V-cam 38 and a flat cam 39. Therefore, before the moving lever 31 is pushed forwardly, the cam shaft 25 projecting from the elongated hole 30 on the housing 16 remains fitted in the flat cam 39 and the cable support 15 is located outside with standing against the spring member. From this condition, if the moving lever 31 is pushed out forwardly, then the cam shaft 25 slides to the V-cam 38 and the cable support 15 is biased toward PC card by the spring 22.

The lever 33 further includes a retaining groove 40, described later, between the cam section 37 and the push-button part 32.

Inside the guiding part 12, a guiding groove 12B is formed with a channel-like cross section, as similar to the opposite guiding part 11, discussed above, for guiding the side face 5 of the PC card 1. A ground spring 42 is provided between the guiding groove 12B and the PC card 1, the PC card being moved along the guiding grooves 11B and 12B of the guiding section 11 and 12, so as to be grounded to the substrate in contact with a contact point of the PC card 1. A screw hole 12A, similar to that of the guiding part 11, is also formed in the guiding part 12.

The guiding parts 11 and 12 are united with a coupling part 43 in the middle of the guiding section. The coupling part 43 provides a pin-like support point 44 in the middle with a swinging lever 45 attached. As mentioned above, the retaining groove 40 is formed on the edge of the lever part 33, while a retained end 46 is formed to be bent at one end of the swinging lever 45 on the guiding side 11. The retained end 46 is movably put in and retained by the retaining groove 40.

A card removing lever 47 is provided outside of the guiding part 12, which includes a lever member 49 extending forwardly from a push-button part 48 and an auxiliary lever member 50 connected to the lever member 49. On the inside face of the push-button part 48, a groove 51 is formed so that the card removing lever 47 can be guided along a guiding rail 52 on the outside face of the guiding part 12. In the middle of the lever member 49, a retaining slot 53 is formed so that a retained claw 54 can be movably put therein and fixed, the retained claw 54 being formed to be bent at the other end of the swinging lever 45. In the forth side of the lever member 49, an elongated retaining hole 55 is formed so as to put an L-type retained claw 56 therein, the retained claw 56 being formed at the back end of the auxiliary lever member 50. The auxiliary lever member 50 also includes a retaining groove 57 at the forth end.

In the neighborhood of the coupling part 13, which unites two guiding parts 11 and 12 in the forefront, a receiving member 58 is provided over the guiding parts 11 and 12. The receiving member 58 is movable back and forth and receives the front end face of the PC card 1. The receiving member 58 provides windows thereon with bumping faces 59 each formed to bump into the front end face of the PC card 1 by bending one of the window edges and extending it downwardly. The receiving member 58 also provides an pushed face 60 to be pushed out backwardly by a plate-like shifter lever described below.

The plate-like shifter lever 61 is movably attached around a pin 62 on the coupling part 13; one end 63 is retained by the retaining groove 57 of the auxiliary lever 50 and the other end forms a pushing face 64 to hit the pushed face 60.

According to such a structure mentioned in the above embodiment, the PC card is inserted into and removed from the connector in the following manner.

(1) Before insertion of the PC card 1, the push-button part 32 of the moving lever 31 projects outside (backside), so that the cam shaft 25 on the bottom of the cable support 15 is retained by the flat cam 39 of the moving lever 31 to put the cable support 15 in a place where the cable support 15 in the housing 16 has moved toward the outside against the spring 22.

(2) The PC card 1 is then inserted in the guiding grooves 11B and 12B of the guiding parts 11 and 12 to the predetermined position. The PC card 1 inserted in the guiding parts is put in the connector through the connection members 14A so as to be electrically connected with the connector.

(3) In this condition, the push-button part 32 of the moving lever 31 is pushed forwardly. As a result, the cam shaft 25 of the cable support 15 retained by the flat cam 39 moves to V-cam 38 and thereby the spring 22 biases the cable support 15 toward the PC card 1. The projecting shaft 21 of the cable support 15 then enters the retaining hole 7 of the PC card 1 so that the PC card 1 can be positioned and prevented from dropping off, while the coaxial terminals 18 are connected to the shielded connection terminals 6, respectively.

(4) Removal of the PC card 1 is performed by the card removing lever 47. The push-button part 48 of the card removing lever 47 is first pushed forward and thereby the swinging lever 45, retained at the retaining slot 53 of the card removing lever 47, starts swinging on the support point 44 to force the moving lever 31 to retreat backward with the retained end 46 of the swinging lever 45. In other words, the cam shaft 25 of the cable support 15 moves from the V-cam 38 to the flat cam 39 away from the PC card. The projecting shaft 21 of the cable support 15 therefore comes off the retaining hole 7 of the PC card 1, while the coaxial terminals 18 are removed from the respective shielded connection terminals, resulting in a standby condition that the PC card 1 can be removed from the connector without any trouble. As discussed above, when pushing the card removing lever 47, the swinging lever 45 also starts swinging, though, the auxiliary lever 50 remains still until the retained claw 56 hits the back edge of the retaining hole 55 since the retaining hole 55 of the card removing lever 47, in which the retained claw 56 has been put, is an elongated hole with a long span.

(5) Next, when the card removing lever 47 is pushed still more forward, the back edge of the retaining hole 55 pushes out the retained claw 56 of the auxiliary lever 50 forward and thereby the auxiliary lever 50 forces the shifter lever 61 to pivot on the pin 62. The moved shifter lever 61 then pushes out the pushed face 60 of the receiving member 58 with its pushing face 64 so as to move the receiving member 58 backward. The retreat of the receiving member 58 causes the PC card 1 to be pushed back and disconnected from the connector, thereby removing the PC card 1 manually.

Figure 7:
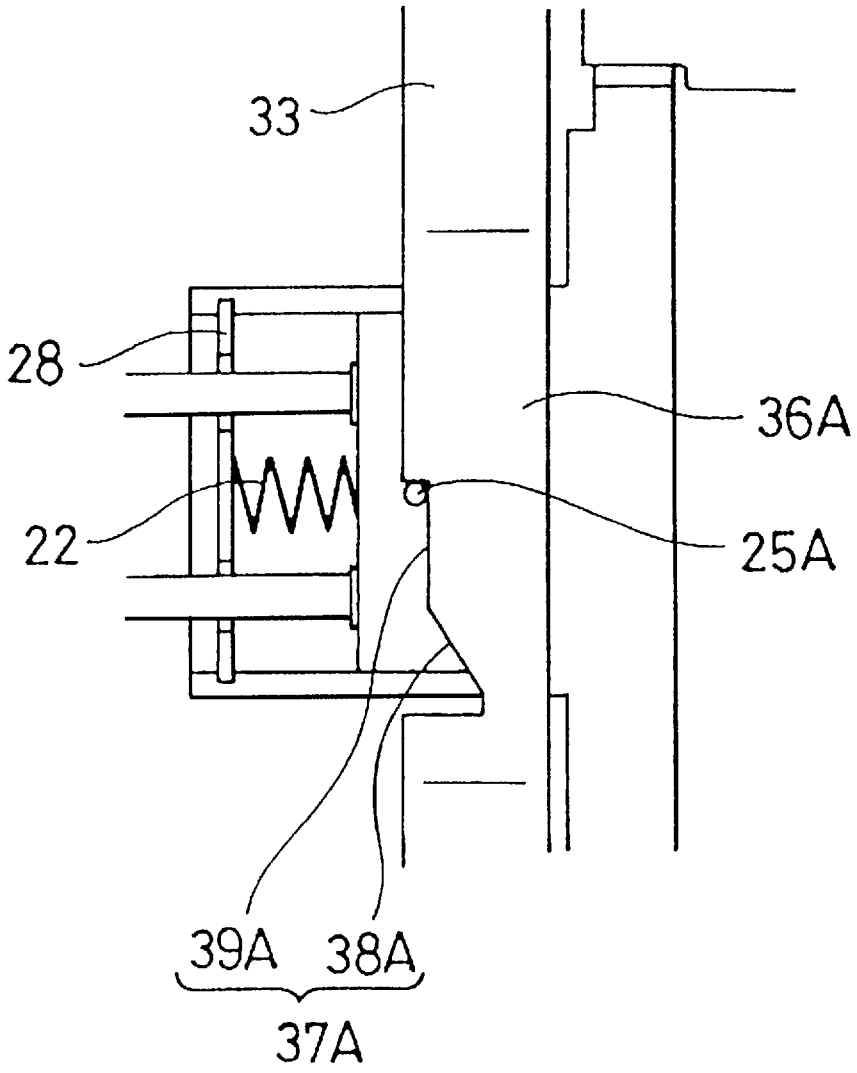
FIG. 7 is a fragmentary plan view showing a modified example of the moving lever shown in FIG. 1.

While the bend 36 of the moving lever 31 is formed below and around the cable support 15 (housing 16) in this embodiment, a bend 36A may be formed above and around the cable support 15, as shown in FIG. 7. In this case, a cam section 37A may be provided on the bend 36A, including a V-cam 38A and a flat cam 39A. A cam shaft 25A will be also formed so as to project upward from the cable support 15 for interaction with the V-cam 38A and the flat cam 39A.

Figure 8:
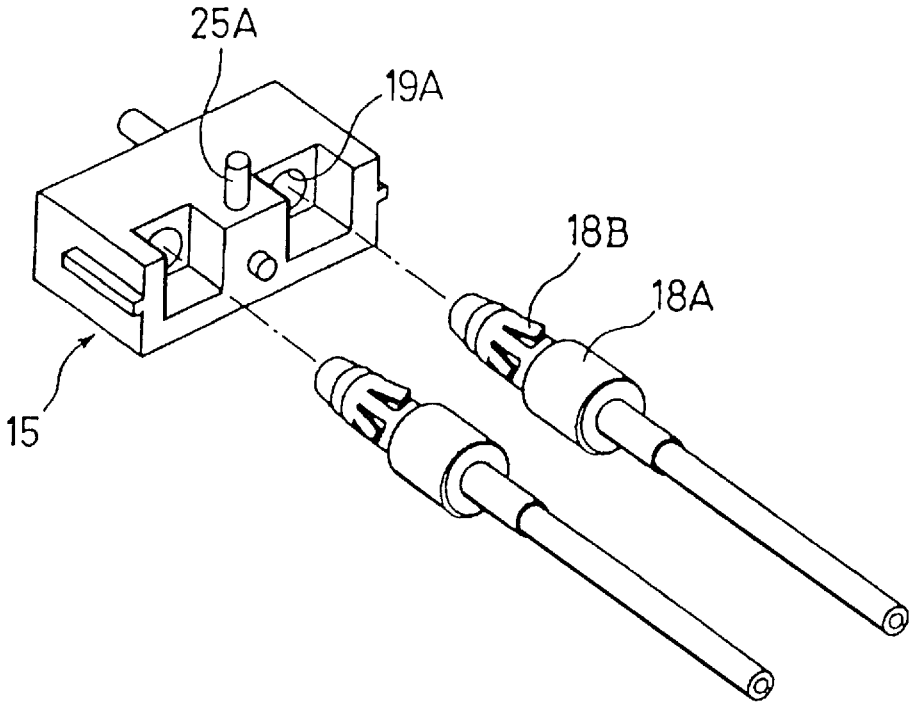
FIG. 8 is a fragmentary perspective view showing a modified example of the cable support and the coaxial terminals shown in FIG. 1.

Furthermore, while the coaxial terminals 18 connected with the shielded cables 17 is housed in the cable support 15 by tightening a cover 20 with screw 20A in the above embodiment, the present invention is not limited thereto and, as shown in FIG. 8, the coaxial terminals 18A may be sufficiently housed in the cable support 15 without cover. In this case, it has only to attach lances 18B to the coaxial terminals 18A and insert them to insertion holes 19A of the cable support 15, respectively.

Figure 9:
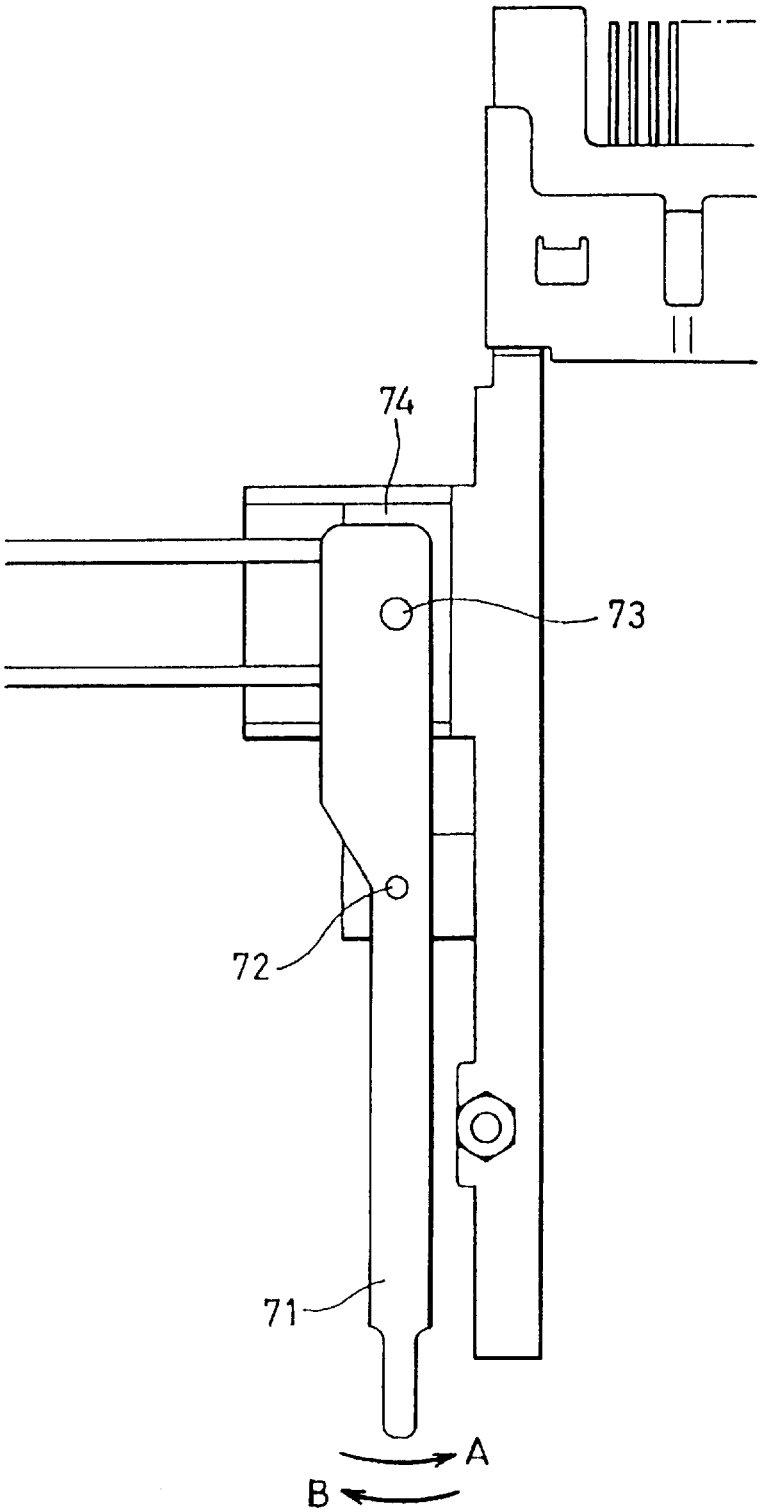
FIG. 9 is a plan view of another embodiment of the present invention.

Next, another embodiment of the present invention will be described. In the above embodiment of FIGS. 1 to 6, the moving lever performs reciprocating motion in the insertion direction. Alternatively, in this embodiment of FIG. 9, a moving lever 71 is swingable on a support point 72 in directions A and B. The moving lever 71 is swingingly coupled by a pin 73 to a cable support 74. The swing operation in the direction A separates the moving lever 71 from the PC card, not shown, while the swing operation in the direction B moves the moving lever 71 closely to the PC card.

Figure 11:
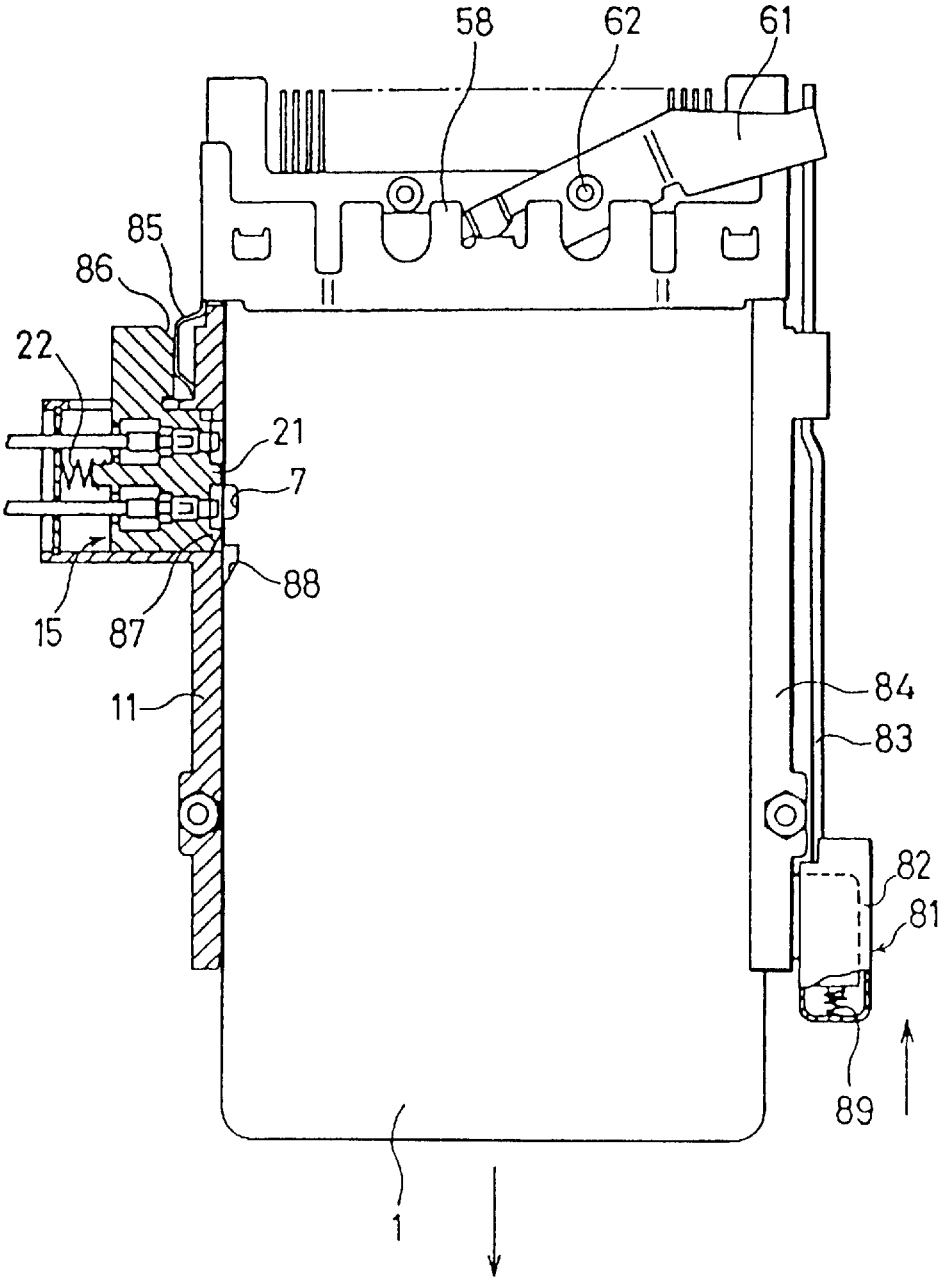
FIG. 11 is a plan view of the embodiment of FIG. 10, showing a state that the cable support has finished moving from the PC card.
Figure 12:
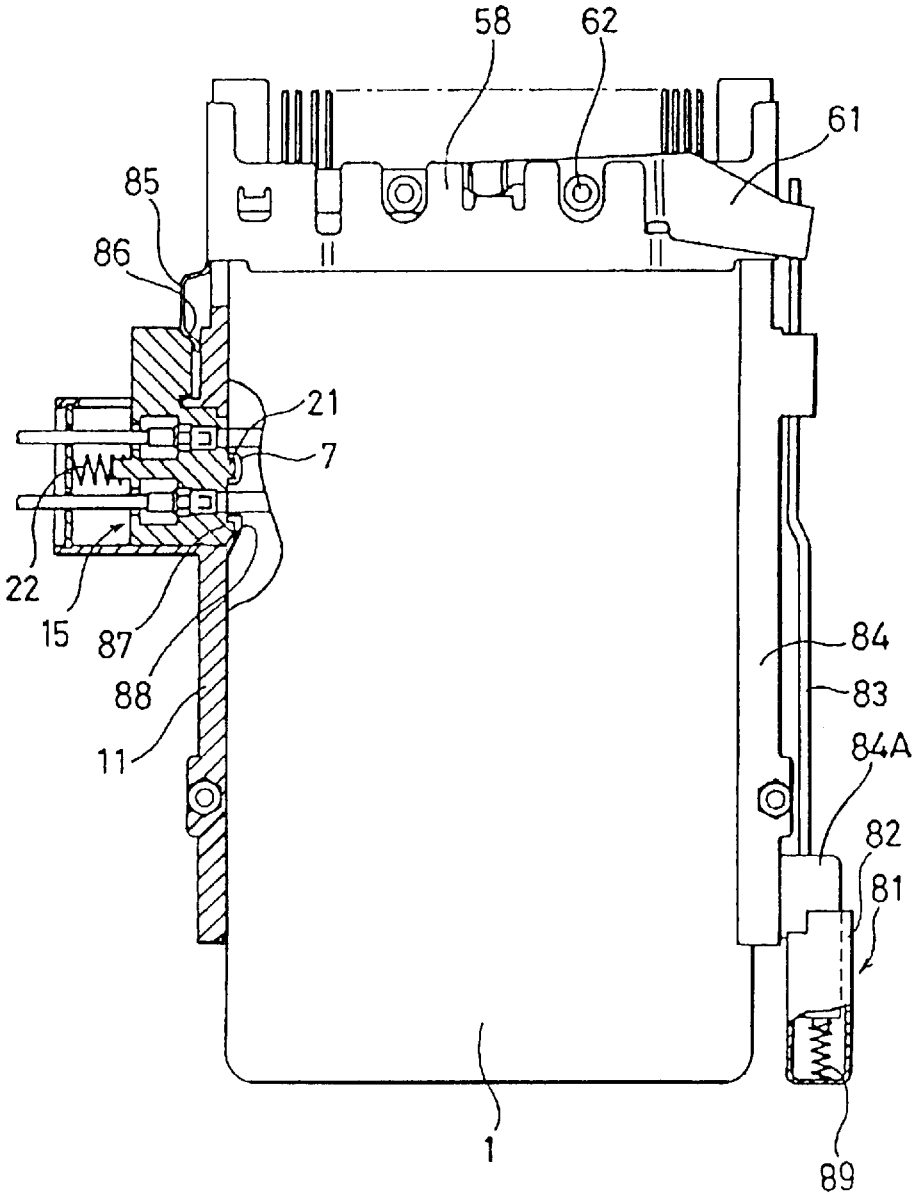
FIG. 12 is a plan view of the embodiment of FIG. 10, showing a state that the cable support has been connected to the PC card.

Next, still another embodiment of the present invention will be described. The above two embodiments are in need of two kinds of levers; the one is a card removing lever and the other is a moving lever for moving the cable support from or to the PC card. Alternatively, this embodiment shown in FIGS. 10 to 12 is characterized in that the moving operation of the cable support can be performed by only a card removing lever.

Figure 10:
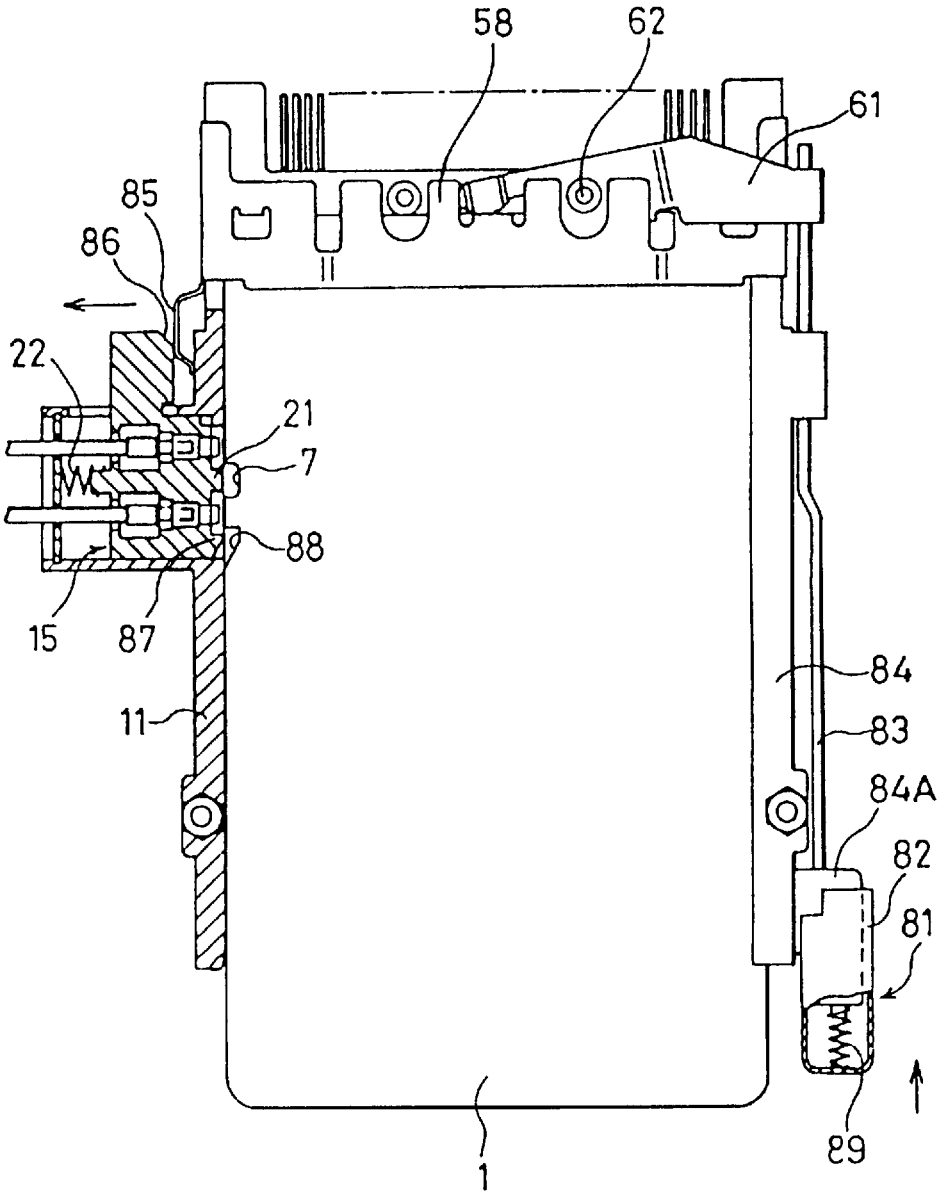
FIG. 10 is a plan view of still another embodiment of the present invention, showing a state that the cable support has started moving away from the PC card.

Referring to FIG. 10, a card removing lever 81 includes a push-button part 82 and a lever member 83 extending forward from the push-button part 82. The card removing lever 81 is guided back and forth by a guiding member 84A of a guiding part 84 in the rear and swingingly coupled to the shifter lever 61 in the front. In this embodiment, the shifter lever 61 and the receiving member 58 interlocking therewith are the same as those of the embodiment of FIGS. 1 to 6, so that those elements are represented by the same reference numbers and their detail description will be omitted.

In the embodiment, a trapezoidal bend 85 is formed at the end of the receiving member 58 and along the outside face of the guiding part 11, i.e., on the cable support 15 side. On the other hand, the cable support 15 partially projects forward and forms a tapered part 86 on the top side. In such a structure, the bend 85 affects the tapered part 86 to move the cable support 15 away from the PC card 1 just before removal operation of the PC card by the card removing lever 81 (see FIGS. 10 and 11).

Since a coil spring 89 is provided as an elastic member between the guiding member 84A and the push-button part 82, the card removing lever 81 is biased by the coil spring 89 during removal operation of the PC card. On the other hand, after removal operation of the PC card, the card removing lever 81 is returned to the former position before start of the removal operation, so that the cable support 15 is also returned to the former position because of no effect of the bend 85 on the tapered part 86.

In the embodiment, the spring 22 is used for biasing the cable support 15 toward the PC card 1, as similar to the above embodiments. This embodiment, however, operates such that the side face of the PC card hits a tapered projection 87 provided on the backside of the cable support 15 and thereby the cable support 15 is moved away from the PC card at the time of the card insertion. Then, the PC card is inserted still more forward to a predetermined position and thereby the tapered projection 87 is biased by the spring 22 to rush into a tapered cavity 88 (see FIG. 12). As also similar to the above embodiments, the predetermined position of the inserted PC card is decided by the combination of the projecting shaft 21 of the cable support 15 and the retaining hole 7 of the PC card.

Figure 13:
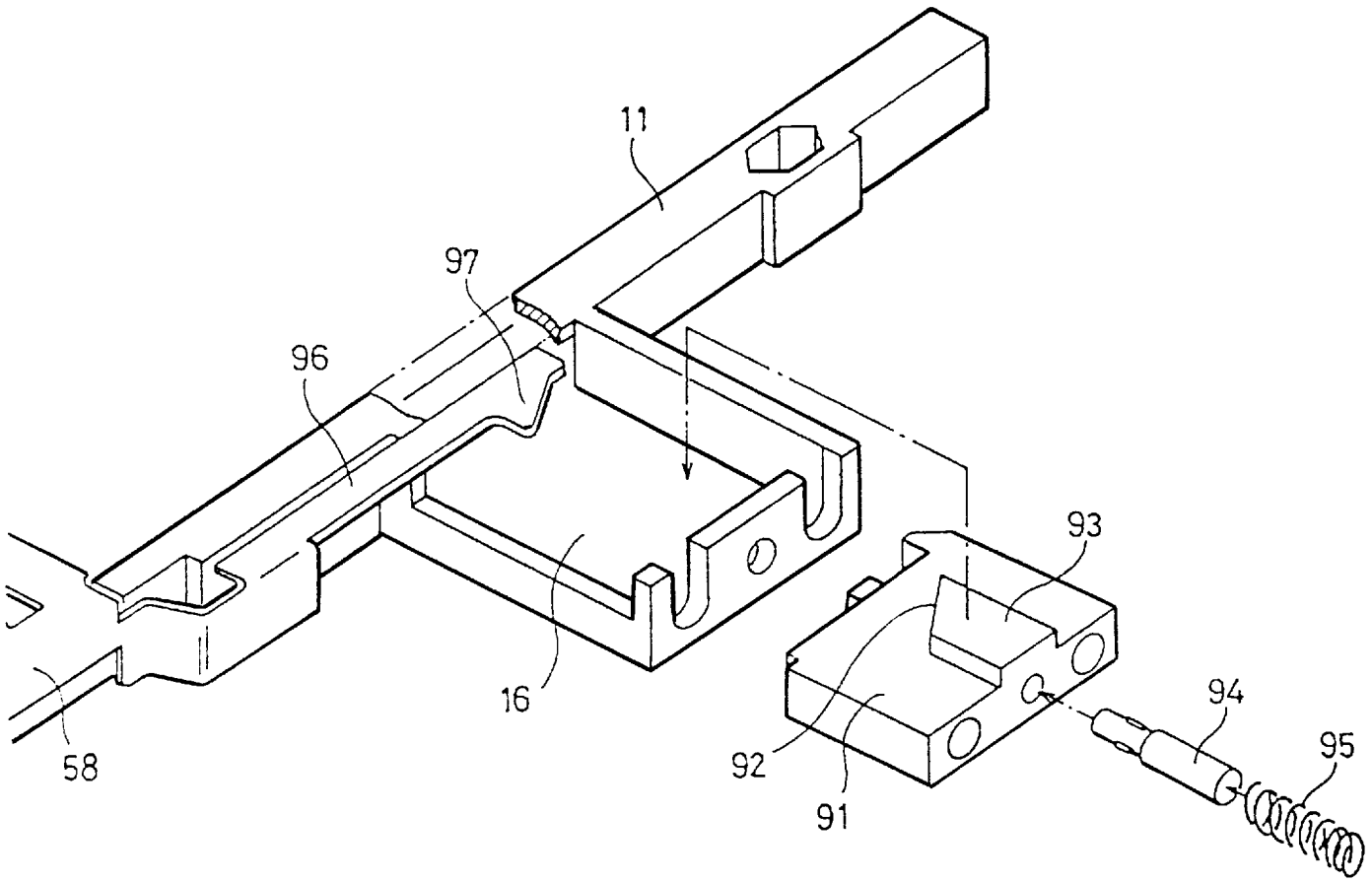
FIG. 13 is a perspective view of still another embodiment of the present invention.

In the embodiment of FIGS. 10 to 12, it may be occurred that the cable support is tilted since the cable support is pushed out at a position apart from the center during moving operation from the PC card. FIG. 13 shows still another embodiment to solve the above problem.

Referring to FIG. 13, a cable support 91 provides a projecting part 93 thereon in the substantially central position. The projecting part 93 includes a bumping face 92 which is cut at an angle. The cable support 91 is housed in the housing 16 in the condition that a cylindrical shaft 94 is put in on the back face and a spring 95 is inserted thereinto. The spring 95 biases the cable support 91 toward the PC card.

Further, in this embodiment, the moving lever extends backward from the receiving member 58, including a slant-shaped projecting edge 97 for striking the bumping face 92 of the cable support 91. According to such a structure, the slant-shaped projecting part 97 strikes the bumping face 92 in the substantially central part at the time of the retreat of the receiving member 58 so as to force the cable support 91 to move from the PC card, thereby preventing the cable support 91 from being tilted.

In any of the embodiments, the spring for biasing the cable support can be either supported by a projection or put in a tube with an enough clearance in order to make the spring position stable. Also, the cover of the cable support can be omitted by attaching the lances to the coaxial terminals.

Further, the present invention can be applied to not only an electrical connector but also an optical fiber connector. In the former case, the coaxial terminals are put in the connection terminals on the side face of the PC card for the electrical connection. On the contrary, the latter case can establish a connection without insertion of the terminals. In this case, the optical fiber terminals have only to come in contact with the connection terminals of the card even if slightly spaced.

As discussed above, this invention permits the PC card to connect with the external signal connection terminals on the side face, so that the thickness of the PC card can be kept uniformly as conventionally sized without reduction of the number of the signal contact elements on the front end face, resulting in easy handling. Also, there is no need to particularly deform or enlarge the slot on the connector side for insertion of the PC card and this makes it possible to solve the problem such that the dust is apt to enter.

What is claimed is:

1. A connector for a PC card which includes a plate-like body having a front face and at least one side face extending in a card insertion direction; a plurality of signal contact elements provided at said front face for coupling to a connector; at least one signal connection member provided on said side face for receiving and sending signals from and to an external signal connection member; and retaining means provided on said side face and separated from said signal connection member so as to fix the PC card in a predetermined position relative to the connector, comprising:

a guiding section having a pair of guide tracks;

a receiving member movable back and forth in said card insertion direction for receiving said front face of the PC card at a time of connection with said contact elements of the connector;

a signal connection support movably disposed on one said guide track of said guiding section opposed to said side face of the PC card and having at least one signal terminal member and positioning means separated from said signal terminal;

a spring member provided between said guide track and said signal connection support to bias said signal connection support toward said side face of said PC card so that said positioning means and said signal terminal member engage with said retaining means and said signal connection member, respectively, of said PC card; and moving means for manually moving said signal connection support from said side face of said PC card against said spring member.

2. A connector for the PC card according to claim 1, wherein said moving means includes a moving lever extending in said card insertion direction and a cam section provided both in a middle part of said moving lever and said signal connection support such that when said moving lever is pushed forwardly, said cam section permits said spring member to move said signal connection support toward said side face of the PC card so that said positioning means and said signal terminal member engage with said retaining means and said signal connection member, respectively, of said PC card.

3. A connector for the PC card according to claim 1, wherein said moving means includes a moving lever extending in said card insertion direction and swinging on a supporting point, so that said signal connection support is permitted to move from and toward said side face of the PC card by swinging said moving lever at said outside end.

4. A connector for the PC card according to claim 1, wherein said moving unit includes a card removing lever moved along said side of said guiding section opposite to said signal connection member and a shifter lever swingingly supported by a support point on a coupling part operative to couple two guiding parts of said guiding section together, said shifter lever of which one end is movably connected with a front end of said card removing lever or its related part and the other end forms a pushing face operative to move said receiving member in said card removal direction, so that said receiving member or its related part cooperates with part of said signal connection support to form a cam unit operative to move said signal connection support away from said side face of the PC card.

5. A connector for the PC card according to claim 4, wherein said cam unit operates prior to card removal.

6. A connector for the PC card according to claim 1, wherein said positioning means is a projecting shaft to be fitted in said retaining means of the PC card.

* * * * *